US009494292B2

(12) United States Patent
Bremerich et al.

(10) Patent No.: US 9,494,292 B2
(45) Date of Patent: Nov. 15, 2016

(54) LIGHT FIXTURE

(75) Inventors: Matthias Bremerich, Lennestadt (DE); Markus Goerres, Dortmund (DE)

(73) Assignee: ERCO GMBH, Luedenscheid (DE)

( * ) Notice: Subject to any disclaimer, the term of this patent is extended or adjusted under 35 U.S.C. 154(b) by 672 days.

(21) Appl. No.: 12/639,198

(22) Filed: Dec. 16, 2009

(65) Prior Publication Data

US 2010/0165623 A1 Jul. 1, 2010

(30) Foreign Application Priority Data

Dec. 30, 2008 (DE) ..... 10 2008 063 369

(51) Int. Cl.

| | |
|---|---|
| ***F21V 5/00*** | (2015.01) |
| ***F21V 13/04*** | (2006.01) |
| ***F21V 17/00*** | (2006.01) |
| *F21W 131/10* | (2006.01) |
| *F21W 131/107* | (2006.01) |
| *F21Y 101/02* | (2006.01) |
| *F21Y 105/00* | (2016.01) |

(52) U.S. Cl.

CPC ..... *F21V 5/002* (2013.01); *F21V 5/007* (2013.01); *F21V 5/008* (2013.01); *F21V 13/04* (2013.01); *F21V 17/002* (2013.01); *F21W 2131/10* (2013.01); *F21W 2131/107* (2013.01); *F21Y 2101/02* (2013.01); *F21Y 2105/001* (2013.01)

(58) Field of Classification Search

CPC ..... F21V 5/007; F21V 5/008; F21V 5/002; F21V 13/04; F21V 7/0091; F21Y 2105/00

USPC ..... 362/97.3, 29, 97.4, 147, 148, 153, 362/153.1, 219, 222, 223, 224, 245, 331, 362/339, 404, 235

See application file for complete search history.

(56) References Cited

U.S. PATENT DOCUMENTS

| | | | | |
|---|---|---|---|---|
| 5,839,823 | A | 11/1998 | Hou et al. | |
| 6,019,493 | A * | 2/2000 | Kuo et al. | 362/335 |
| 6,550,941 | B1 | 4/2003 | Keuper | 362/337 |
| 6,657,393 | B2 * | 12/2003 | Natsume | 315/82 |
| 7,628,512 | B2 | 12/2009 | Netzel, Sr. et al. | |
| 7,831,034 | B2 | 11/2010 | Maximo et al. | |
| 7,918,583 | B2 | 4/2011 | Chakmakjian et al. | |
| 8,070,329 | B1 * | 12/2011 | Bechtel et al. | 362/331 |
| 8,123,384 | B2 * | 2/2012 | Negley et al. | 362/331 |
| 2002/0034081 | A1 * | 3/2002 | Serizawa | B60Q 1/2696 362/540 |
| 2003/0112523 | A1 * | 6/2003 | Daniell | 359/626 |

(Continued)

FOREIGN PATENT DOCUMENTS

| | | | |
|---|---|---|---|
| DE | 10142582 | A1 | 4/2003 |
| JP | 2006092485 | A | 4/2006 |

(Continued)

OTHER PUBLICATIONS

Machine translation of Wo 2006/045545.*

*Primary Examiner* — Robert May
*Assistant Examiner* — Leah S Macchiarolo
(74) *Attorney, Agent, or Firm* — Andrew Wilford

(57) ABSTRACT

The invention shows and describes, among others, a light fixture (10) for illuminating building surfaces, comprising a circuit board (11) on which a plurality of LEDs (12*a*, 12*b*, 12*c*) are mounted, secondary optics (14) that bundle the light emitted by the LEDs, and tertiary optics (16) formed by a planar, translucent element that has light-directing micro-structures.

21 Claims, 3 Drawing Sheets

(56) References Cited

U.S. PATENT DOCUMENTS

| | | | | |
|---|---|---|---|---|
| 2006/0139953 | A1* | 6/2006 | Chou et al. | 362/613 |
| 2007/0159833 | A1 | 7/2007 | Netzel et al. | |
| 2007/0263388 | A1 | 11/2007 | Lai et al. | |
| 2008/0013313 | A1 | 1/2008 | Schroll | 362/231 |
| 2008/0030974 | A1 | 2/2008 | Abu-Ageel | |
| 2008/0084693 | A1* | 4/2008 | Shimada et al. | 362/240 |
| 2009/0231835 | A1* | 9/2009 | Roberts et al. | 362/97.3 |

FOREIGN PATENT DOCUMENTS

| | | | |
|---|---|---|---|
| JP | 2007149552 | A | 6/2007 |
| JP | 2008305802 | A | 12/2008 |
| WO | WO-2004045545 | | 5/2006 |

* cited by examiner

LIGHT FIXTURE

FIELD OF THE INVENTION

The invention relates to a light fixture for illuminating building surfaces.

BACKGROUND OF THE INVENTION

Light fixtures for illuminating building surfaces are any light fixtures serving as floor, wall or ceiling lamps of a building, optionally as spotlights or recessed fixtures for illuminating a building surface or part of a building surface. Similarly, they can be fixtures capable of illuminating the surfaces of exterior areas of a building, e.g. parking lots, green areas, or walkways. Building surfaces to be illuminated also include paintings or art objects to be illuminated.

In the course of the further improvement of LEDs, they are now increasingly used for illuminating building surfaces. Currently the light distribution that can be achieved with a light fixture operating on LEDs—at least in certain cases of application—is not satisfactory.

OBJECT OF THE INVENTION

The object of the invention is therefore initially to provide a light fixture having an improved, and if necessary, previously determined and exact light distribution. Furthermore, the invention seeks to provide a light fixture allowing a change in light distribution by recourse to standardized light-fixture parts by changing only a few parts of the light fixture.

SUMMARY OF THE INVENTION

The principle of the invention is substantially the equipping of a light fixture with a circuit board, secondary optics, and tertiary optics. The circuit board is the part that carries one or more LEDs. The light fixture may also comprise a plurality of circuit boards. The circuit board generally comprises a printed-circuit board on which the LEDs are mounted either by soldering or any other suitable type of mounting. The circuit board therefore forms the mechanical support for the LED or for a plurality of the LEDs.

The LEDs may also consist of any desired construction. They may be monochrome or multicolor, or LEDs having different colors. The LEDs already comprise primary optics. They may be, for example a lens body formed from a transparent plastic or similar material that has been mounted directly on the LED, typically during manufacturing of the LED. They may also focus the light such that the LED commercially equipped with primary optics has a radiation angle of 120° to 180°. Other radiation angles are also possible.

The light fixture according to the invention further comprises secondary optics that bundle the light emitted by the LEDs. Secondary optics are formed by one or more lenses that are translucent and have exactly calculated boundary surface paths in order to bundle the light emitted by the LEDs. In particular the secondary optics serve to transmit the light emitted by the LEDs substantially on parallel light paths that may be provided for further light-technical processing of subsequent tertiary optics.

Secondary optics may be formed by elements having a cup-shaped cross-section that flares away from the LEDs. The lenses may be placed directly on the circuit board and may overlap the respective LEDs there such that they may absorb the entire light emitted by the respective LEDs and further process them with regard to light technology. Secondary optics means both a lens arrangement representing a one-piece part overlying multiple LEDs, and a plurality of such lenses overlying the individual LEDs.

Preferably the circuit board is fixedly mounted on a fixture housing. The secondary optics are also fixedly mounted on the fixture housing. In a further preferred manner the secondary optics are also directly fixed on the circuit board.

The light fixture according to the invention further comprises tertiary optics. The term tertiary optics takes into consideration that the optics represent the third element in the direction of the light path that causes a light deflecting effect.

The tertiary optics in the light fixture according to the invention are formed by a planar, translucent element. A planar element is any planar, plate-shaped element, but optionally also a concave domed element that has a thin wall. In particular, crown-shaped planar elements also fall under the term tertiary optics.

The tertiary optics are translucent, e.g. they generally permit light to pass through them. Due to the light-directing microstructures provided according to the invention, however, a direction of the light occurs.

Light-directing microstructures in the sense of the present patent application include all surface structures incorporated into one or both outer faces of the element. They may be previously calculated and predetermined to a very exact degree, and may be machined into a mold. In particular, the microstructures may have facets, the light-directing outer faces of which are formed by concave domed surfaces, or by planar surfaces.

In the case of the tertiary optics being a plate a structured grid of such facets may extend over the entire plate surface. To this end facets having a concave surface and facets having a planar surface may alternate. As an alternative the invention may provide that areas of facets having a concave surface, and areas of facets having a planar surface extend along the plate surface. Finally, the plate surface may also be divided into different sections, facets having a first type of concavity being in a first section, and facets having a second type of concavity being in a second section. In particular, facets may also be provided that allow light to penetrate without any light-directing effect.

Due to a surface topography of the translucent element that has been predetermined in a detailed manner the radiation behavior of the light fixture may be predetermined to a very accurate degree. Due to an arrangement of certain facets having certain surface properties, such as by a selection of the type of surface, the radiation behavior of the light fixture may be influenced in the desired manner.

The following example is selected to show the above as follows: presuming that the translucent element is formed by a flat plate whose inner face, e.g. the face of the secondary optics, being completely covered with spherical facets. By the selection of the radius of the individual facets the radiation angle of the light fixture may then be influenced. If facets are used that uniformly have very small radius, a greater radiation angle is created than if facets are consistently used whose surface concavity has a greater radius. In this manner a light fixture may optionally be equipped with a lens plate having microlenses of a first type or using another lens plate having microlenses of a second type. By changing the tertiary optics (also of the lens plate) the radiation behavior of the light fixture may be altered accordingly.

In this manner light fixtures using LEDs as light sources may be realized for the first time that have both the radiation behavior of a spotlight with substantially the same exterior construction and use of identical parts, such as a circuit boards and secondary optics, and the radiation behavior of a floodlight, or of a wide floodlight (having a large radiation angle) with the alternate use of tertiary optics.

The light-directing microstructures may be formed in different manners. For example, it is conceivable that the tertiary optics are formed by a plastic injection-molded part. In this case the light-directing microstructures maybe be machined into the tool form. During manufacture of the injection-molded part the structures are transferred to the blanks accordingly.

Theoretically it is also possible to individually produce the light-directing microstructures by individual tool machining, i.e. by milling each workpiece. Although this is considered quite labor-intensive, it should also be comprised by the invention.

Additionally it should be noted that light-directing microstructures mean in the sense of the patent application only those microstructures that are set up for a predetermined light radiation behavior and for optimizing a desired light intensity distribution. Light-directing microstructures in the sense of the patent application do not involve merely the roughening of the surface of the tertiary optics, for example, by etching or sand blasting, as only diffuse scattering and not light-directing microstructures would be provided in this manner.

According to an advantageous embodiment of the invention the microstructures are formed by facets. This enables individual predetermination and calculation of the surfaces of the facets.

At least some of the facets have a concave surface. This enables, for example, the realization of a desired light distribution by a selection of the concavity of the surface.

Advantageously, the surface of the facets is spherically arced. In this manner use can be made of conventional design methods.

As an alternative or in addition, the surface of some facets may be aspherically arced. A particularly optimized light distribution of the light fixture—although with the requirement of complicated simulations—can be achieved in this manner.

It is further advantageous that the surface of at least some of the facets is arced cylindrically. To this end use can be made of calculation methods which are already applied for manufacture of reflectors having facets.

Also advantageously, the surface of at least some of the facets is formed by a rotational paraboloid. This enables in particular the achieving of desired cut-off angles, and thus a sharp definition of the light intensity distribution at the lateral edges.

In a further advantageous manner the invention provides that at least some of the facets have a planar surface. This enables a targeted light direction of luminous flux proportions into certain corner areas.

To this end the planar surface is generally at an inclined angle to the main radiation direction of the LEDs.

Advantageously, the microstructures are on the side of the element that faces the secondary optics.

As an alternative, and/or in addition the microstructures may also be on the face of the element facing away from the secondary optics.

In a particularly advantageous manner the element is set at a spacing from the secondary optics. This enables a particularly advantageous construction, in particular mounting of the tertiary optics on a fixture housing of the light fixture as a function of the mounting of the secondary optics on the fixture housing.

According to a further advantageous embodiment of the invention the secondary optics applies projects parallel light beams on the tertiary optics. This embodiment of the invention makes use of secondary optics that bundle the light emitted by the LEDs in a particularly advantageous manner. Substantially parallel light beams are light beams that are directed against the tertiary optics by the secondary optics. This enables a particularly well predetermined light-technical further processing of the LED light emitted by the secondary optics.

According to a further advantageous embodiment of the invention the element is formed by a flat plate. This enables the construction of a light fixture having a very good compact shape. Furthermore, a light-technically optimized interaction with LEDs mounted on a planar circuit board can be ensured by tertiary optics comprising an element having a planar plate.

In an alternative embodiment of the invention the element is concave. The embodiment of the invention can be used in an advantageous manner, for example, if the circuit board is concave, or a plurality of circuit boards and a plurality of LEDs are positioned and mounted with respect to one another such that the LEDs in their entirety are arranged along a concave three-dimensional surface.

According to a further embodiment of the invention the element has a plurality of sections with different light-technical behaviors. To this end, for example, a first section is provided on an element with microstructures of a first type being provided, and a second section is provided with microstructures of a second type. The light-directing structures of the first type may, for example, be formed by spherically concave facet surfaces, and the microstructures of the second type may be formed by cylindrically concave facet surfaces. Any other desired constellation of surface specifications are also possible. The different sections may be embodied in a recognizable pattern. However, the individual different facet surfaces can be arrayed in a pattern that is not recognizable by an observer. The pattern is only revealed with a deep understanding of the simulation method by means of which the radiation behavior of the light fixture is simulated on a computer before the construction of respective tertiary optics.

It is further advantageously provided that the circuit board and the secondary optics are provided within a fixture housing. Optionally it may also be provided that the tertiary optics are provided within the fixture housing. Finally, it may be provided that the tertiary optics are provided on or near the light beam opening of the light fixture like a light-fixture cover glass piece.

In this manner use can be made of light fixtures in a substantially convention type of construction, and—if desired—also in compact construction shapes.

It may further advantageously be provided that the tertiary optics can be mounted on a fixture housing of the light fixture using fasteners. In this manner it may also be ensured, for example, that the tertiary optics are removably attached to the fixture housing. Finally, changing tertiary optics such that the tertiary optics are designed as "exchangeable" tertiary optics may be ensured in this manner.

The invention further relates to a modular system for light fixtures.

The invention is based on the object of providing a modular system for light fixtures that allows different radiation characteristics of light fixtures while enabling the use of existing parts and the switching of only few parts.

The principle of the invention is to provide a modular system for light fixtures for illuminating building surfaces. The modular system comprises a circuit board on which a plurality of LEDs are mounted. Furthermore, secondary optics are provided that bundle the light emitted by the LEDs. Finally, the modular system comprises first tertiary optics of a predetermined shape. Tertiary optics of a predetermined construction shape means a planar, translucent element that has light-directing microstructures of a first type and predetermined dimensions. In case of the element being a plate, this also includes, for example, the dimension of the plate with regard to width and height. In case of a translucent element that is concave, this also includes, for example, the depth of the concavity and the rim diameter.

Second tertiary optics of the same construction shape are also part of the modular system. The second tertiary optics in turn are formed by a planar, translucent element. However, it has no light-directing microstructures of a second type. The first tertiary optics can be switched with the second tertiary optics. The exchangeability means that the second tertiary optics can be mounted on a fixture housing of the light fixture using the same fasteners as the first tertiary optics. The first tertiary optics may also be removed from the light fixture and replaced by the second tertiary optics.

Secondary tertiary optics denotes a plate having the same dimensions with regard to width and height in the case of a plate element, or in case of a cup-shaped element a plate having the same depth of concavity and the same rim diameter.

As a further characteristic according to the invention the invention provides that the microstructures of the second type enable a radiation characteristics of the light fixture that different from that of the microstructures of the first type. This means that the microstructures of the second type are not shaped the same as the microstructures of the first type. Single or all surfaces of the individual facets are shaped or positioned differently.

In this manner a completely changed, optimized radiation behavior of the light fixture may be achieved by changing the tertiary optics while keeping identical parts of the light fixture, e.g. an identical fixture housing, an identical circuit board, or identical secondary optics.

By way of example it should be noted that the first tertiary optics may be, for example, a plate having a lens structure comprising numerous lenses made from facets having a concavity that is arced about a first large radius, and second tertiary optics being shaped similarly, wherein however, the individual facets have a concavity that extends about a different, smaller radius. While the first element creates a light-radiation characteristic of the light fixture with a smaller radiation angle, the element enables a radiation characteristic of the light fixture at a large radiation angle with the use of secondary optics.

Advantageously, the invention provides that the macrostructures of the first type comprise facets having light-directing surface of the first type, and that the microstructures of the second type comprise facets having light-directing surfaces of the second type. As with the embodiment of the light fixture according to the invention as described above, the microstructures may be facets. The facets each have individually predetermined and precalculated surfaces that may guide the light impinging upon them. By the selection of the type of surface and positioning of the surface the guiding of the light in the desired manner may be carried out for achieving a desired light distribution of the light fixture.

According to a further advantageous embodiment of the invention the first tertiary optics create a radiation angle of the light emitted by the light, and the second tertiary optics create a second radiation angle that differs from the first radiation angle. In this manner a radiation angle of the light fixture, for example, may be changed only by changing the tertiary optics. Therefore, in a group of light fixtures a first light fixture may provide a spotlight distribution, a second light fixture a floodlight distribution, and a third light fixture a broad floodlight distribution with respective small, medium, and large radiation angles. All three light fixtures of this group comprise an identical exterior construction shape and identical parts and housing, different tertiary optics being provided as the only differing part.

The invention further relates to a modular system.

The invention is based on the object of creating a modular system where a changed radiation characteristic of the light fixture is enabled while making use of substantially identical parts and the switching of only few parts. The invention solves the problem.

The principle of the invention is that a first and a second planar translucent element is provided, both having the same predetermined construction shape. The planar, translucent element is mounted on a housing of the light fixture in an exchangeable manner. The first translucent element has microstructures of a first type, and the second translucent element has microstructures of a second type. The radiation characteristic of the light fixture is changed by changing the translucent element.

The translucent element further does not necessarily need to be comprised of tertiary optics, but the translucent element may—assuming a conventional light source such as a low-voltage halogen lamp or any other desired particularly also punctiform light source—be the first, quasi primary optics of the light system.

BRIEF DESCRIPTION OF THE DRAWING

Further advantages are obvious from the following description of the embodiments shown in the drawings. Therein.

DETAILED DESCRIPTION OF THE INVENTION

The light fixture shown at 10 in its entirety in the figures will be explained below based on the drawings. It should be noted that, for reasons of clarity of description of the figures, the same or comparable parts or elements, also with regard to different embodiments, are referenced by the same symbols.

Figure 1:
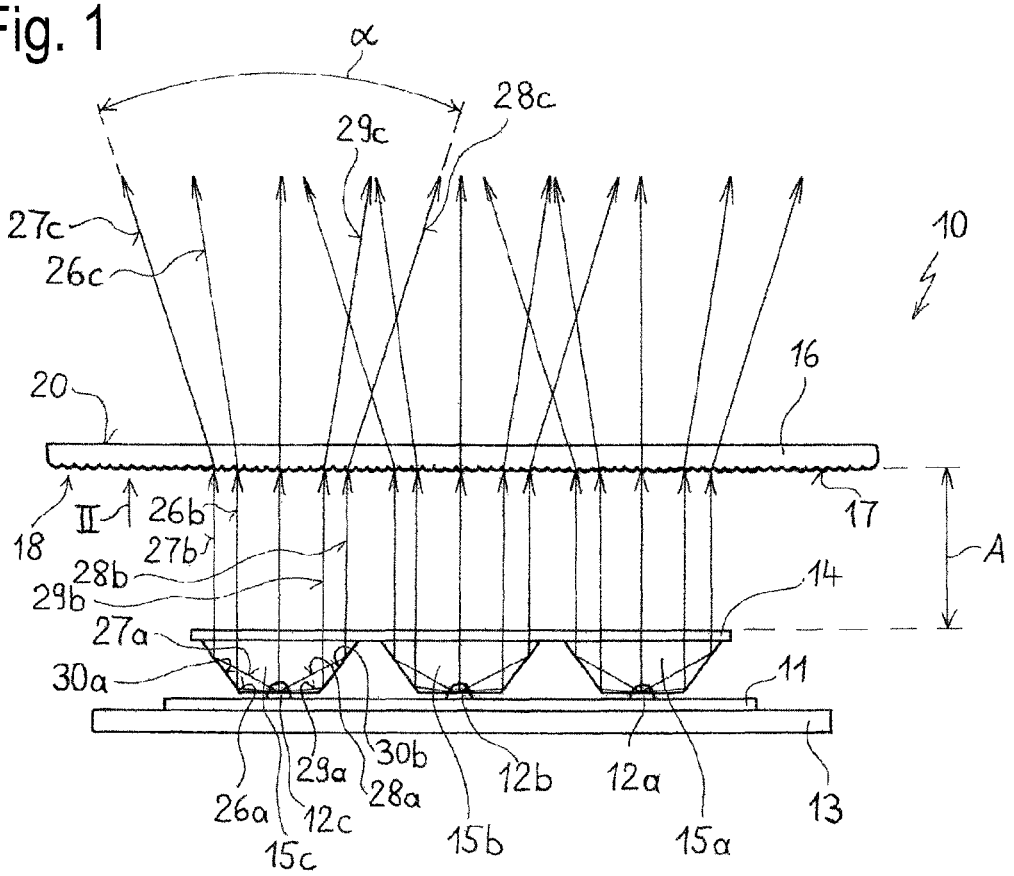
FIG. 1 is a schematic illustration of a first embodiment of a light fixture according to the invention, comprising a circuit board, secondary optics, and tertiary optics, and having a light path illustrated by way of example by a number of arrows.

FIG. 1 shows a first embodiment of a light fixture 10 according to the invention with the fixture housing omitted for reasons of clarity.

FIG. 1 shows a printed-circuit plate or circuit board 11, on which three LEDs 12*a*, 12*b*, and 12*c* are mounted as shown. The printed-circuit board 11 may be mounted, for example, on a carrier plate 13.

Further parts necessary for operating the LEDs, such as microprocessors, resistors, capacitances, electric connection lines, cooling elements, etc., are not shown. In this regard—such as also in the remaining figures—FIG. 1 is to be understood merely to be schematic.

The LEDs 12*a*, 12*b*, 12*c* are overlain by secondary optics 14 according to FIG. 1. The secondary optics 14 are a plurality of respective lenses 15*a*, 15*b*, 15*c* formed from transparent plastic. According to the figures, the lenses are each of a cross-section that widens upward as shown in FIG. 1. The lenses are shown only schematically in FIG. 1. They actually each have a plurality of boundary surfaces that bundle the light emitted by the LEDs 12*a*, 12*b*, 12*c*. FIG. 1 shows that, as becomes obvious, for example, based on the light beam bundle of the light beams 26, 27, 28, and 29, a light beam bundle 26*a*, 27*a*, 28*a*, 29*a* is initially emitted by the LEDs that has a very broad distribution. In other words, the light emitted by the LED 12*c* has, for example, a radiation angle of about 120° up to nearly 180°.

Figure 2:
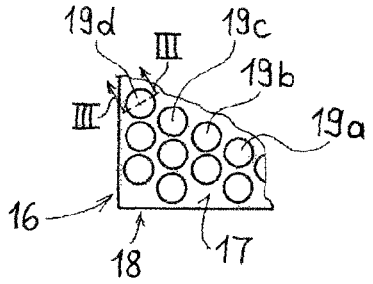
FIG. 2 is a partially sectional view according to arrow II in FIG. 1 of the lower face of the tertiary optics.

The lens body 15*c* overlying the LED 12*c* has a plurality of boundary surfaces with only the boundary surfaces 30*a* and 30*b* shown in FIG. 2. The light beams 26*a*, 27*a*, 28*a*, 29*a* are totally reflected on the boundary surface 30*a* and 30*b* such that a bundle of light beams 26*b*, 27*b*, 28*b*, 29*b* is emitted by the secondary optics 14 that are substantially parallel.

It should be noted that this phenomenon is also schematically illustrated and simplified, and serves for the better understanding of the invention.

Tertiary optics 16 are arranged at a spacing A from the secondary optics. The spacing A is between 1 and 100 mm. The spacing A is preferably also between 10 and 80 mm, advantageously between about 10 and 50 mm. The tertiary optics 16 in the embodiment of FIG. 1 are formed by a plate-shaped, translucent, e.g. transparent element. They may be comprised, for example, of plastic.

It has a lower face 17 turned toward the secondary optics 14, and an upper face 20 directed away from the secondary optics 14.

Light-directing microstructures 18 are provided on the lower face 17 of the tertiary optics 16 in the embodiment of FIG. 1.

FIG. 2 shows that the microstructures 18 are formed by a plurality of facets 19*a*, 19*b*, 19*c*, 19*d* of which only some are shown in FIG. 2. In the embodiment of FIG. 2 the facets are provided with a spherically concave surface 21*a*. According to FIG. 3 the facet 19*d* may have a spherical surface 21*a* that is curved about a radius of curvature r. According to FIG. 4 the facet 19*d* may alternatively also have a curved surface 21*b* that is curved about a radius of curvature R, R being significantly greater than r.

Figure 3:
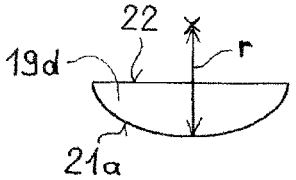
FIG. 3 is a first embodiment of a spherical facet approximately according to section line of FIG. 2.
Figure 4:
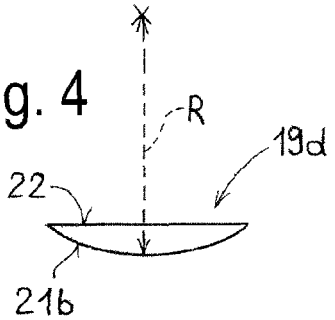
FIG. 4 is a view like FIG. 3 of an embodiment of a spherical facet that is different from that of FIG. 3.

The schematic representations of FIGS. 2 to 4 merely serve to show that the microstructures 18 may be shaped completely differently and may be optimally adjusted to light-technical requirements and to the desired radiation behavior of the light fixture. In the simplest of cases the facets 19*a* to 19*d* may all be identical. Thus the entire lower face 17 of the tertiary optics 16 may be formed by an array of identical microlenses according to FIG. 3. In this regard all of these facets 19 may have a constant radius of curvature r.

In an alternative embodiment of the invention the facets have radii of curvature r that are different.

A light fixture 10 using first tertiary optics 16 comprising numerous facets 19 having radii of curvature r has a completely different light-radiating behavior than a light fixture comprising second tertiary optics 16 of identical construction, but having changed microstructures 18, the curved surface 21 of the facets having a radius of curvature R.

FIG. 1 shows that with microstructures of a first type a certain light radiation behavior of the light fixture is achieved: the parallel light beam bundle 26*b*, 27*b*, 28*b*, 29*b* is expanded into a light beam bundle 26*c*, 27*c*, 28*c*, 29 according to FIG. 1. The expanded radiation angle is denoted by a in FIG. 1.

When using microstructures of a second type that is different from the first type, such as when using facets having a surface 21*b* according to FIG. 4, a changed radiation angle can be achieved that is smaller with the selection of a larger radius of curvature R of the surface 21*b* of the facets.

The invention is not merely limited to use changed radii of curvature in order to vary the radiation angle of the light fixture. Instead, the invention intends to enable a completely changed light radiation characteristic by positioning different facets and by shaping individual surfaces 21 of individual facets 19. In this manner, for example, the light field contour and the distribution of intensity may be changed in any desired manner within the light field contour. To this end the surface topography of the lower face 17 of the first tertiary optics may be shaped differently overall as opposed to the surface topography of the second tertiary optics.

Figure 5:
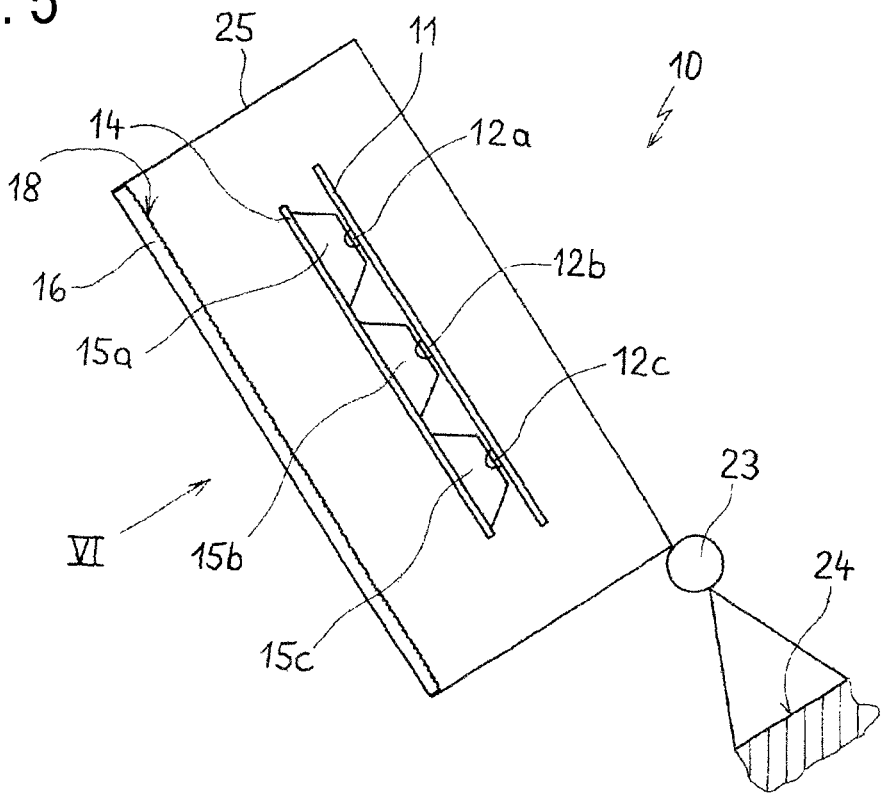
FIG. 5 is a further embodiment of a light fixture according to the invention in a schematic illustration.

FIG. 5 shows in a further embodiment that the circuit board 11, the secondary optics 14, and the tertiary optics 16 are attached to a fixture housing 25, or installed within the fixture housing. The attachment element, the electric supply lines, and further required electric and electronic parts and cooling bodies are not shown in FIG. 5 for reasons of clarity.

The fixture housing 25 can be pivotally mounted on a mounting surface 24 on a wall by a joint 23. Conventional attachments of a fixture housing 25 on wall surface may also be used.

Figure 6:
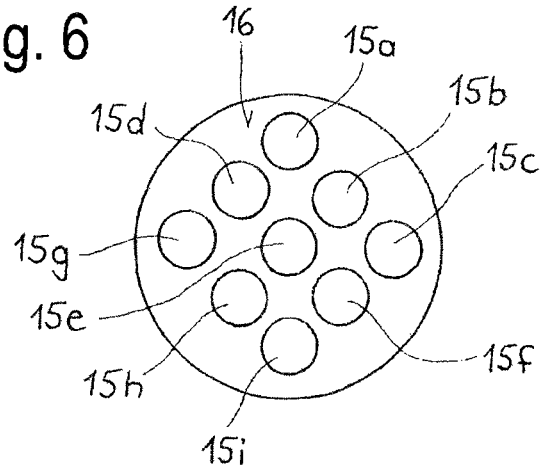
FIG. 6 is a schematic view the embodiment of FIG. 5 according to arrow VI.

FIG. 6 shows that the secondary optics 14 may comprise, for example, nine lenses 15*a*, 15*b*, 15*c*, 15*d*, 15*e*, 15*f*, 15*g*, 15*h*, 15*i*. The respective nine LEDs are not shown in FIG. 6.

However, FIG. 6 clearly shows that the tertiary optics 16 of FIGS. 5 and 6 form a circular part. According to FIG. 5 they have microstructures 18 of a first type. The tertiary optics 16 may be removed from the fixture housing 25 and replaced by different tertiary optics having microstructures 18 of a second type. Since the microstructures of the second type are shaped differently from the microstructures of a first type, the light fixture changed in this manner may provide a changed light radiation characteristic, thus displaying a completely changed light radiation behavior.

Figure 7:
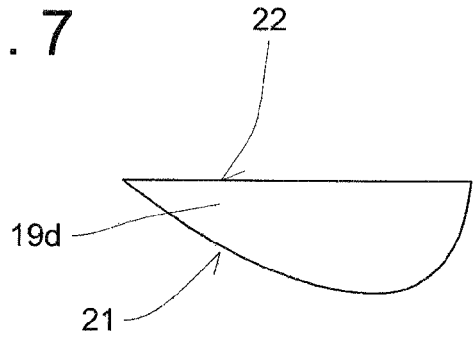
FIG. 7 shows an aspherically curved facet.
Figure 8:
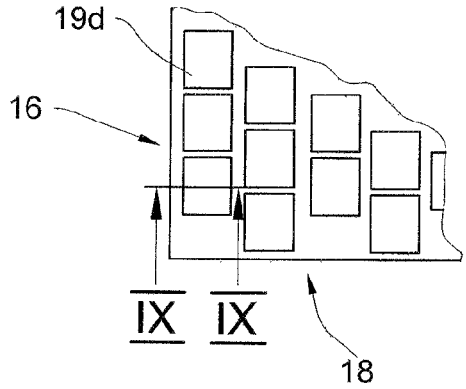
FIG. 8 shows cylindrically curved facets.
Figure 9:
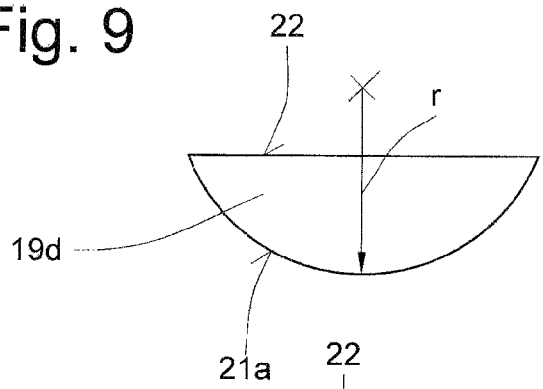
FIG. 9 is a large-scale detail taken along line IX-IX of FIG. 8.
Figure 10:
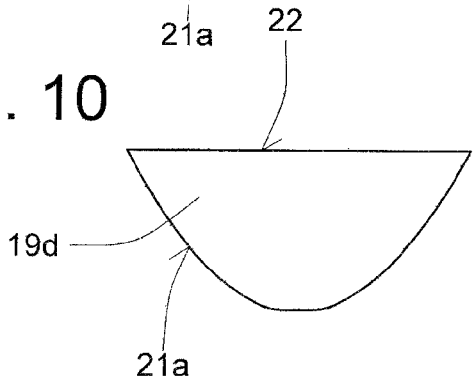
FIG. 10 shows a rotational paraboloidal facet.

FIGS. 7, 8, 9, and 10, which use reference numerals from FIGS. 1-6, show further embodiments of the invention. More particularly FIG. 7 shows an spherically curved facet, FIGS. 8 and 9 show cylindrically curved facets, and FIG. 10 shows a rotational paraboloidal facet.

The invention claimed is:

1. A light fixture for illuminating building surfaces, the fixture comprising:

a circuit board;

a plurality of LEDs mounted on the circuit board and emitting light;

tertiary optics spaced from the circuit board and formed by a flat and translucent element having a face provided with a plurality of domed light-directing facets arranged in rows; and secondary optics formed by one or more lenses of cup-shaped section, each having totally reflective surfaces, between the LEDs on the circuit board and the tertiary optics, and each flared toward the tertiary optics such that the secondary optics totally transform all the light emitted by the LEDs into a single bundle of light beams all substantially parallel to one another and directed at a right angle against the tertiary optics.

2. The light fixture defined in claim 1, wherein the facets are of identical shape.

3. The light fixture defined in claim 1, wherein each facet is encircled by a plurality of other facets.

4. The light fixture defined in claim 1, wherein the facets each have a curved surface.

5. The light fixture defined in claim 4, wherein the curved surface is spherically curved.

6. The light fixture defined in claim 4, wherein the curved surface is aspherically curved.

7. The light fixture defined in claim 4, wherein the curved surface is cylindrically curved.

8. The light fixture defined in claim 4, wherein the curved surface is a rotational paraboloid.

9. The light fixture defined in claim 1, wherein the facets are provided on a face of the element turned toward the secondary optics.

10. The light fixture defined in claim 1, wherein the facets are provided on a face of the element directed away from the secondary optics.

11. The light fixture defined in claim 1, wherein the element is at a spacing from the secondary optics.

12. The light fixture defined in claim 1, wherein the element is a plate that is planar except at the facets.

13. The light fixture defined in claim 1, wherein the element is curved.

14. The light fixture defined in claim 1, wherein the element comprises a plurality of sections having different light-technical behaviors.

15. The light fixture defined in claim 1, further comprising:

a fixture housing holding the circuit board, the secondary optics, and the tertiary optics.

16. The light fixture defined in claim 1, wherein the tertiary optics are provided in a light-output opening of the light fixture in the manner of a light fixture cover glass piece.

17. The light fixture defined in claim 1, wherein the facets are formed unitarily on the flat translucent element.

18. A modular system for light fixtures for illuminating building surfaces, the system comprising a circuit board;

a plurality of LEDs mounted on the circuit board and emitting light;

first tertiary optics of a predetermined construction, spaced from the circuit board, and formed by a flat, translucent element having a face provided with a plurality of domed light-directing facets of a first type arranged in rows;

secondary optics formed by one or more lenses of cup-shaped cross section between the LEDs on the circuit board and the tertiary optics and each having totally reflective surfaces such that the secondary optics totally transform all the light emitted by the LEDs into a single bundle of light beams all substantially parallel to one another and directed at a right angle against the tertiary optics; and second tertiary optics of the same construction as the first tertiary optics but having facets of a second type, the first tertiary and the secondary tertiary optics being constructed such that the secondary tertiary optics can be exchanged with the first tertiary optics, the facets of the second type enabling a radiation characteristic of the light fixture that is different from that of the facets of the first type.

19. The modular system defined in claim 18, wherein the facets of the first type comprise facets having light-directing surfaces of a first type, and the facets of the second type comprise facets have light-directing surfaces of a second type.

20. The modular system defined in claim 18, wherein the first tertiary optics enable light radiation from the light fixture at a first radiation angle, and the second tertiary optics enable light radiation at a second radiation angle that is different from the first radiation angle.

21. A light fixture for illuminating building surfaces, the fixture comprising:

a circuit board;

a plurality of LEDs mounted on the circuit board and emitting light;

tertiary optics spaced from the circuit board and formed by a flat and translucent element having a face provided with a plurality of domed light-directing facets arranged in rows; and secondary optics formed by one or more lenses of cup-shaped section between the LEDs on the circuit board and the tertiary optics and each having totally reflecting surfaces for bundling the light emitted by the LEDs and thereby totally transforming the light emitted by the LEDs into a bundle of parallel light beams directed against the tertiary optics.

* * * * *